US007178589B2

(12) United States Patent
Campbell et al.

(10) Patent No.: US 7,178,589 B2
(45) Date of Patent: Feb. 20, 2007

(54) THRU TUBING TOOL AND METHOD

(75) Inventors: John E. Campbell, Houston, TX (US); Charles H. Dewey, Houston, TX (US); Chad D. Evans, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 123 days.

(21) Appl. No.: 10/719,199

(22) Filed: Nov. 21, 2003

(65) Prior Publication Data

US 2004/0149430 A1 Aug. 5, 2004

Related U.S. Application Data

(60) Provisional application No. 60/428,014, filed on Nov. 21, 2002.

(51) Int. Cl.
*E21B 7/08* (2006.01)
*E21B 23/01* (2006.01)

(52) U.S. Cl. ..... 166/216; 166/117.6; 166/217; 175/61; 175/81

(58) Field of Classification Search ..... 166/117.6, 166/117.5, 50, 216, 217, 206; 175/61, 81
See application file for complete search history.

(56) References Cited

U.S. PATENT DOCUMENTS 1,835,227 A * 12/1931 Lane et al. ..... 166/117.6
3,285,345 A * 11/1966 Solum ..... 166/208
3,397,746 A * 8/1968 Link ..... 166/117.6
3,741,304 A * 6/1973 McGill ..... 166/216
4,397,355 A * 8/1983 McLamore ..... 166/297
4,712,614 A 12/1987 Allwin et al.
4,848,462 A 7/1989 Allwin
5,318,131 A * 6/1994 Baker ..... 166/382
5,678,635 A * 10/1997 Dunlap et al. ..... 166/387
5,878,818 A * 3/1999 Hebert et al. ..... 166/382
6,164,377 A * 12/2000 Roberts ..... 166/118
2004/0149430 A1 8/2004 Campbell et al.

FOREIGN PATENT DOCUMENTS

GBUK SEARCH REPORT 6/2005

* cited by examiner

*Primary Examiner*—Kenneth Thompson
(74) *Attorney, Agent, or Firm*—Conley Rose, P.C.; Shannon W. Bates

(57) ABSTRACT

A downhole tool is disclosed that functions as an expandable anchoring tool, capable of passing through a restricted wellbore diameter while in a collapsed position and thereafter translating to an expanded position for grippingly engaging a larger wellbore diameter. An embodiment of the tool includes a body including a plurality of angled channels formed into a wall of the body and a plurality of moveable slips. The plurality of moveable slips translates along the plurality of angled channels between a collapsed position and an expanded position. The slips may include a plurality of extensions corresponding to and engaging the plurality of channels.

26 Claims, 7 Drawing Sheets

THRU TUBING TOOL AND METHOD

CROSS-REFERENCE TO RELATED APPLICATIONS

The present application claims the benefit under U.S.C. §119(e) of U.S. Provisional Application No. 60/428,014 filed on Nov. 21, 2002 and entitled "Thru tubing multilateral sidetracking system", incorporated herein by reference for all purposes.

STATEMENT REGARDING FEDERALLY SPONSORED RESEARCH OR DEVELOPMENT

Not Applicable.

BACKGROUND OF THE INVENTION

1. Field of the Invention

The present invention relates generally to expandable anchoring tools used in drilling operations. Further, the present invention relates to a method and apparatus for drilling a secondary borehole from an existing borehole in geologic formations. More particularly, this invention relates to a relatively small diameter apparatus which can be run into a borehole through a smaller tubing or otherwise restricted section and then expanded to set within a section of larger diameter casing to perform downhole well operations.

2. Description of Related Art

Once a petroleum well has been drilled and cased, it is often necessary or desired to drill one or more additional wells that branch off, or deviate, from the first well. Such multilateral wells are typically directed toward different parts of the surrounding formation, with the intent of increasing the output of the well. The main well bore can be vertical, angled or horizontal. Multilateral technology can be applied to both new and existing wells.

In order to drill a new borehole that extends outside an existing cased wellbore, the usual practice is to use a work string to run and set an anchored whipstock. The upper end of the whipstock comprises an inclined face. The inclined face guides a window milling bit laterally with respect to the casing axis as the bit is lowered, so that it cuts a window in the casing. The lower end of the whipstock is adapted to engage an anchor in a locking manner that prevents both axial and rotational movement.

Multilateral technology provides operators several benefits and economic advantages. For example, multilateral technology can allow isolated pockets of hydrocarbons, which might otherwise be left in the ground, to be tapped. In addition, multilateral technology allows the improvement of reservoir drainage, increasing the volume of recoverable reserves and enhancing the economics of marginal pay zones. By utilizing multilateral technology, multiple reservoirs can be drained simultaneously. Thin production intervals that might be uneconomical to produce alone become economical when produced together with multilateral technology. Multiple completions from one well bore also facilitate heavy oil drainage.

In addition to production cost savings, development costs also decrease through the use of existing infrastructure such as surface equipment and the well bore. Multilateral technology expands platform capabilities where slots are limited and eliminates spacing problems by allowing more drain holes to be added within a reservoir. In addition, by sidetracking damaged formations or completions, the life of existing wells can be extended. Laterals may be drilled below a problem area once casing has been set, thereby reducing the risk of drilling through troubled zones. Finally, multilateral completions accommodate more wells with fewer footprints, making them ideal for environmentally sensitive or challenging areas.

Often however, a well bore is configured such that a tubular string of a smaller diameter is contained within a larger pipe string or casing, making it necessary to run well tools through the smaller diameter tubular and thereafter perform down hole operations (such as sidetracking) within the larger area provide by the larger tubular or casing. An apparatus and method are herein disclosed which allow a relatively small diameter assembly to be run into a borehole through a smaller diameter tubular or similar restriction and set in a relatively large diameter casing. Generally, such operations are known as thru tubing operation. Disadvantages of thru tubing tools known in the prior art include limited radial expansion capabilities and limited ability to securely anchor within the larger tubular diameter. It has been found that conventional thru tubing whipstock supports may be susceptible to small but not insignificant amounts of movement. Hence, it is desired to provide an anchor and whipstock apparatus that effectively prevent an anchored whipstock from moving. These disadvantages of the prior art are overcome by the present invention.

BRIEF SUMMARY OF THE PREFERRED EMBODIMENTS

The preferred embodiments of the present invention feature a downhole expandable anchoring tool that may be used for passing through a restricted wellbore diameter while in a collapsed position and thereafter translating to an expanded position for grippingly engaging a larger wellbore diameter. The use of the expandable anchoring tool of the present invention, however, is not limited to well operations below a restriction, but may be used in any type of wellbore, including but not limited to unrestricted wellbores, cased wellbores, or uncased wellbores.

An embodiment of the tool includes a body with a plurality of angled channels formed into a wall of the body and a plurality of moveable slips. The plurality of moveable slips translates along the plurality of angled channels between a collapsed position and an expanded position. The slips may include includes a plurality of extensions corresponding to and engaging the plurality of channels.

In one preferred embodiment, a piston translates the plurality of slips from the collapsed position to the expanded position. The extensions and the channels comprise a drive mechanism for moving the slips between the collapsed position and the expanded position.

In another preferred embodiment, the extensions and the channels support loading on the slips when the tool is in the expanded position. The slips are adapted to grippingly engage the wellbore in the expanded position. The expandable anchoring tool is not limited to use in a cased wellbore, but may also be used in an uncased or "open" wellbore.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figures 1A, 1B, 1C, 1D:
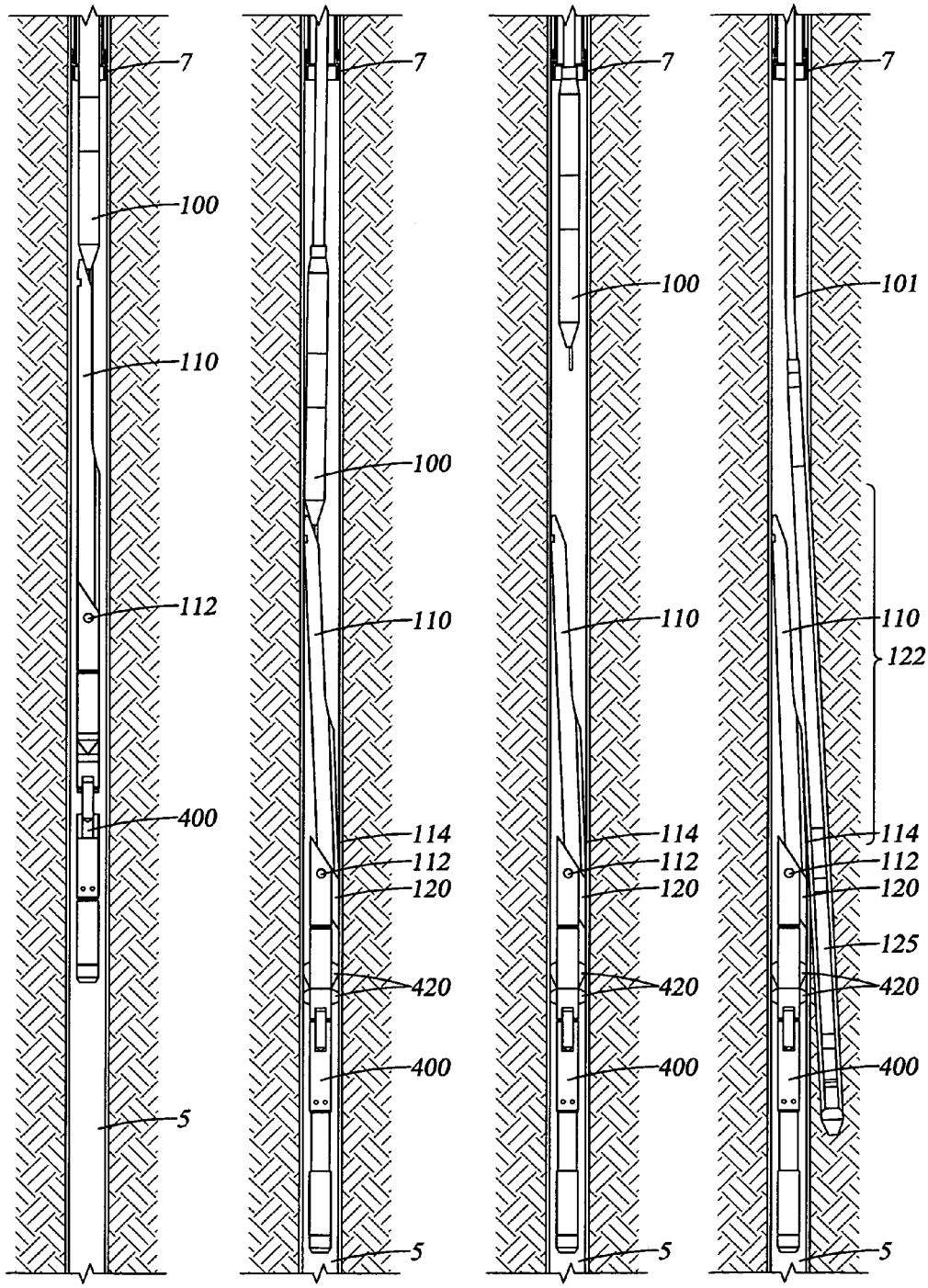
FIGS. 1A through 1H are cross section, sequential views of a method of the present invention.

The present invention relates to methods and apparatus for performing drilling operations below a restriction such as tubing or casing. The present invention is susceptible to embodiments of different forms. There are shown in the drawings, and herein will be described in detail, specific embodiments of the present invention with the understanding that the disclosure is to be considered an exemplification of the principles of the invention, and is not intended to limit the invention to that illustrated and described herein.

The preferred embodiments of the expandable anchor tool of the present invention may be utilized in milling or sidetracking operations below a restriction. The embodiments of the present invention also provide a plurality of methods for use in a drilling assembly. It is to be fully recognized that the different teachings of the embodiments disclosed herein may be employed separately or in any suitable combination to produce desired results.

It should be appreciated that the expandable anchoring tool described with respect to the figures that follow may be used in many different drilling assemblies. The following exemplary systems provide only some of the representative assemblies within which the present invention may be used, but these should not be considered the only assemblies. In particular, the preferred embodiments of the tool of the present invention may be used in any assembly requiring an expandable anchoring tool.

With reference to FIGS. 1–13 the preferred method and apparatus of the present invention will be described. FIG. 1 represents a preferred method of the present invention in eight sequential scenes labeled FIG. 1A through FIG. 1H. FIG. 1A is a cross section of a part of the method where a setting tool 100, whipstock 110, and the expandable anchoring tool 400 are run into the main bore 5 through a restriction 7. In operation, the expandable anchoring tool 400 is lowered through casing in the collapsed position shown in FIGS. 2A–2B and 3, respectively. The tool 400 would then be expanded when fluid flows through flowbore 408.

These tools may be run into the wellbore using conventional techniques, including both coil tubing and drill string methods. FIG. 1B shows the whipstock 110 and anchoring tool 400 being oriented using an orienting tool and set. This orientation may be accomplished using conventional techniques well known by those skilled in the art. In a preferred embodiment, the whipstock 110 and expandable anchoring tool 400 are set hydraulically. As the anchoring tool 400 is set, the slips 420 are extended radially outwardly along angled channels in the housings. In one such embodiment, a piston is contained within a piston cylinder. When hydraulic pressure is applied, the piston 430 acts against the slip housings 421, 422, and 423, thereby applying the necessary force to expand the slips 420 radially via the channels in the housings 421, 422, and 423. Tn another embodiment, the tool 400 contains at least a pair of moveable slips 420 for engagement with a wall of a borehole or casing 120. Preferably, more than one pair of slips 420 is provided. The slip pairs may be offset in planes at a 90 degree angle, thereby providing maximum centralization and stability.

Figure 1E:
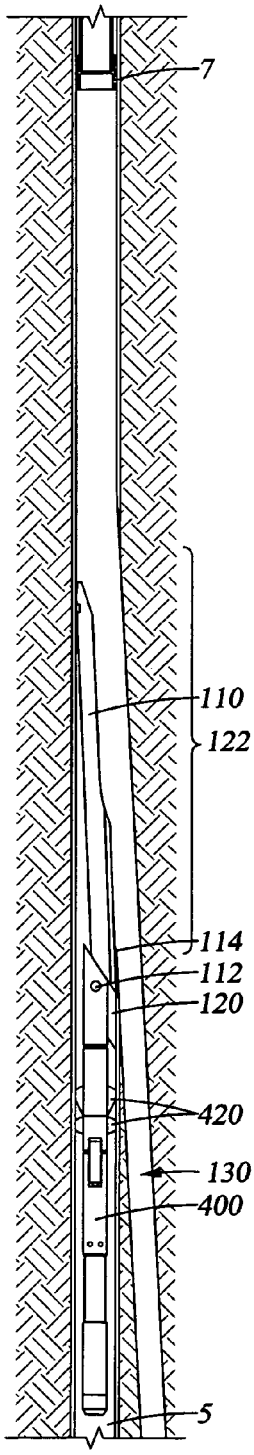
Figure 1F:
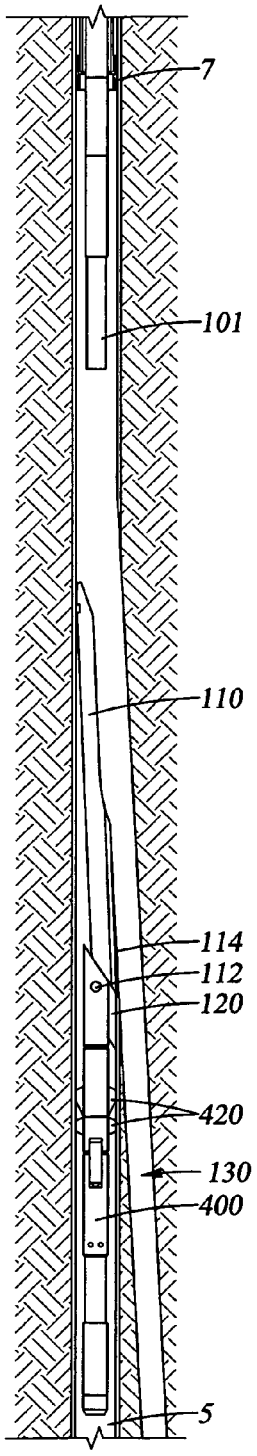
Figure 1G:
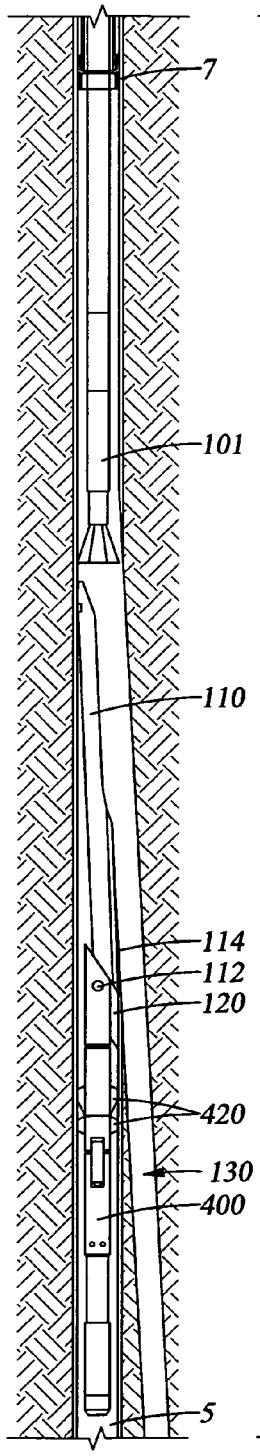
Figure 1H:
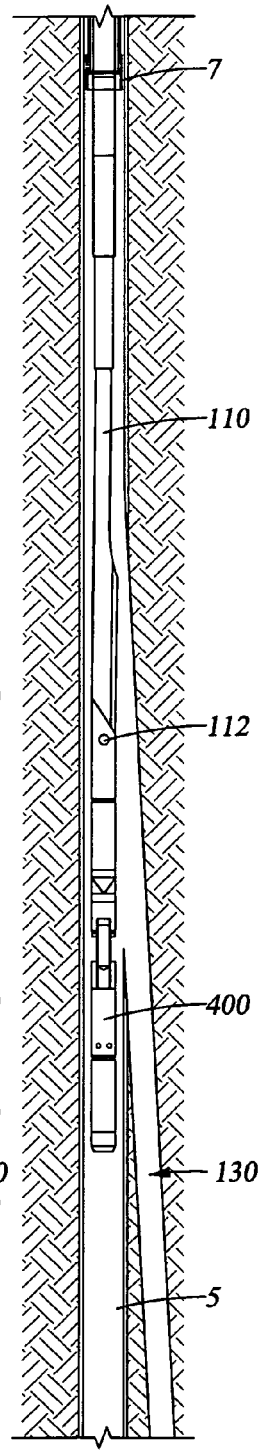

FIG. 1C shows the whipstock 110 in an oriented and set position. A hydraulically actuated hinge section 112 kicks the bottom of the whipstock ramp 114 against the casing wall 120. FIG. 1C shows the setting tool 100 being pulled from the main bore 5 through the restriction 7. FIG. 1D shows a milling assembly 125 in the process of milling the main bore casing 120 to form a casing window 122. The casing window 122 is milled using conventional milling techniques and a lateral rathole 130 and/or borehole is drilled. The use and configuration of these components in the milling operation is well known by those skilled in the art. In FIG. 1E, the lateral well bore 130 is shown having been drilled. In FIG. 1F, a retrieval tool 101 is run into the main bore 5 in preparation for the retrieval of the whipstock 110 and expandable anchoring tool 400. The anchoring tool 400 is designed to release with an upward pull, thereby retracting the slips 420 to a collapsed position. In FIG. 1G the retrieval tool 101 is run into the well bore 5. FIG. 1H illustrates the retrieval of the whipstock 110, including the expandable anchor 400.

It should be recognized that while FIG. 1 illustrates the milling assembly 125 being run in as a separate trip from the whipstock 110 and anchoring tool 400, the milling assembly 125 can be run in the same trip with the whipstock 110 and anchoring tool 400. Thus, the system of the present invention can be run into the well bore, oriented, set, a window milled and a rathole drilled during a single trip.

Another aspect of this invention is an expandable anchoring tool, shown in FIGS. 2A–13. The expandable anchoring tool of the present invention is preferably used in combination with the whipstock assembly for sidetracking operations that take place below a restriction. Referring now to FIGS. 2A–5, one embodiment of the expandable tool of the present invention, generally designated as 400, is shown in a collapsed position in FIGS. 2A–2B and 3 and in an expanded position in FIGS. 4A–4B and 5. The expandable anchoring tool 400 comprises a generally cylindrical tool body 410 with a flowbore 408 extending there through. The tool body 410 includes upper 414 and lower 412 connection portions for connecting the tool 400 into a downhole assembly. One or more recesses 416 are formed in the body 410. The one or more recesses 416 accommodate the radial movement of one or more moveable slips 420.

The recesses 416 further include angled channels 418 that provide a drive mechanism for the slips 420 to move radially outwardly into the expanded position of FIGS. 4A–4B, 5 or 6. A piston 430 that is contained within a piston cylinder 435 engages the lower slip housing 422. The piston 430 is adapted to move axially in the piston cylinder 435. A nose 480 provides a lower stop for the axial movement of the piston 430. A mandrel 460 is the innermost component within the tool 400, and it slidingly engages the piston 430, the lower slip housing 422, and the intermediate slip housing 421. A bias spring 440 is disposed within a spring cavity 445. An upper slip housing 423 coupled to the mandrel 460 provides an upper stop for the axial movement of intermediate slip housing 421. The nose 480 includes ports 495 that allow fluid to flow from the flowbore 408 into the piston cylinder 435 to actuate the piston 430. The piston 430 sealingly engages the mandrel 460 at 466, and sealingly engages the piston cylinder 435 at 434.

In one embodiment, a threaded connection is provided at 456 between the slip housing 423 and the mandrel 460 and at 458 between the nose 480 and piston cylinder 435. A threaded connection is also provided between the nose 480 and the mandrel 460 at 457. The nose 480 sealingly engages the piston cylinder 435 at 405. The upper slip housing 423 sealingly engages the mandrel 460 at 462.

Figure 2A:
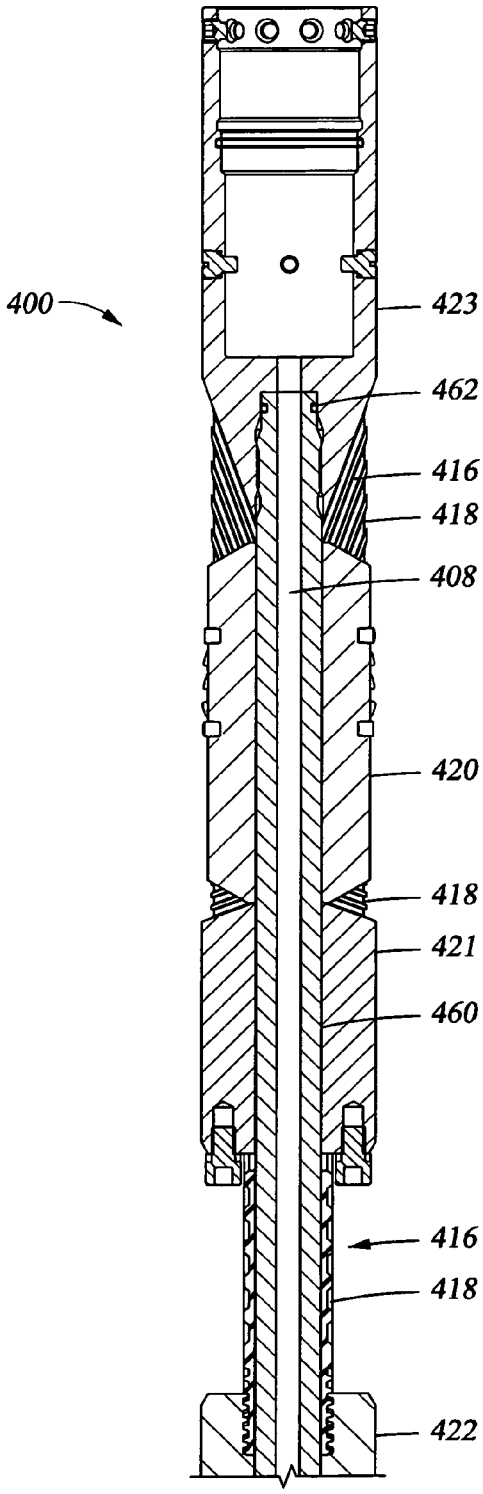
FIGS. 2A and 2B, when viewed end to end, depict a side cross section view of the expandable anchoring tool of the present invention in a collapsed position.
Figure 2B:
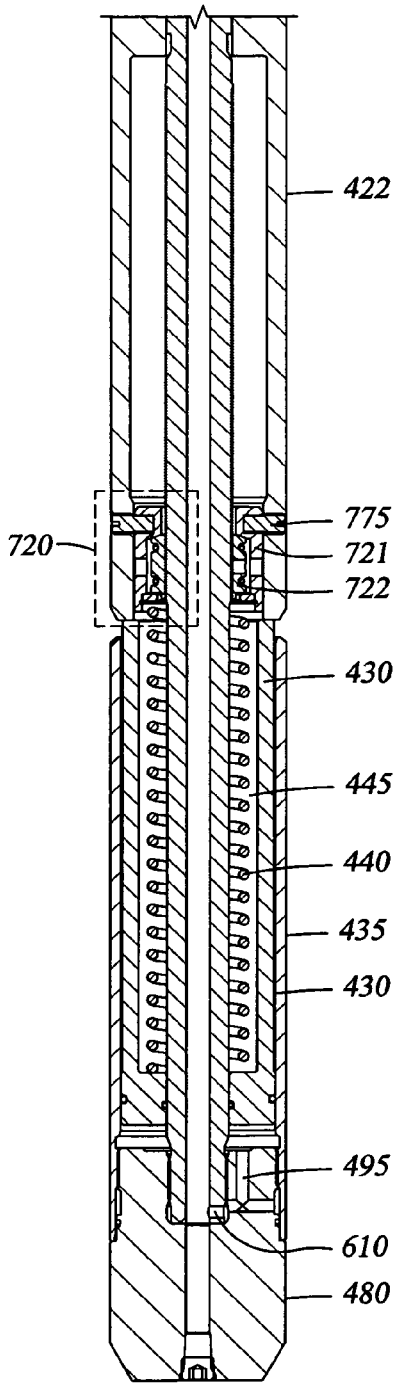
Figure 3:
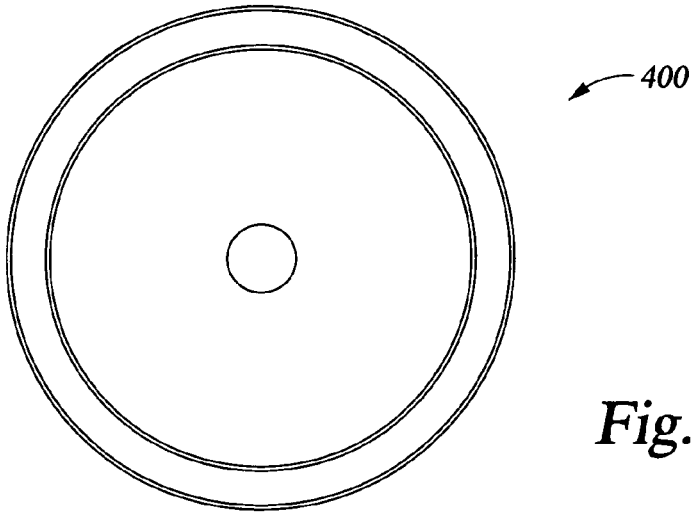
FIG. 3 is a top, cross section view of the expandable anchoring tool in a collapsed position.
Figure 5:
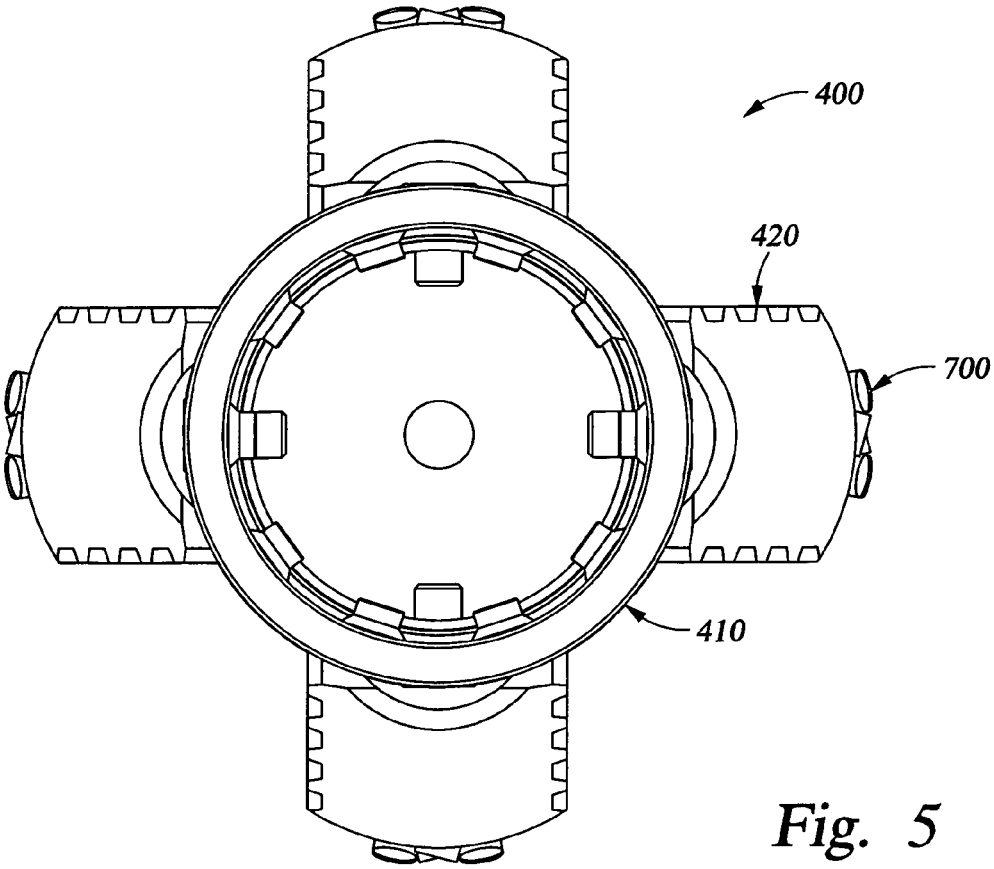
FIG. 5 is a top, cross section view of the expandable anchoring tool in an expanded position.
Figure 4A:
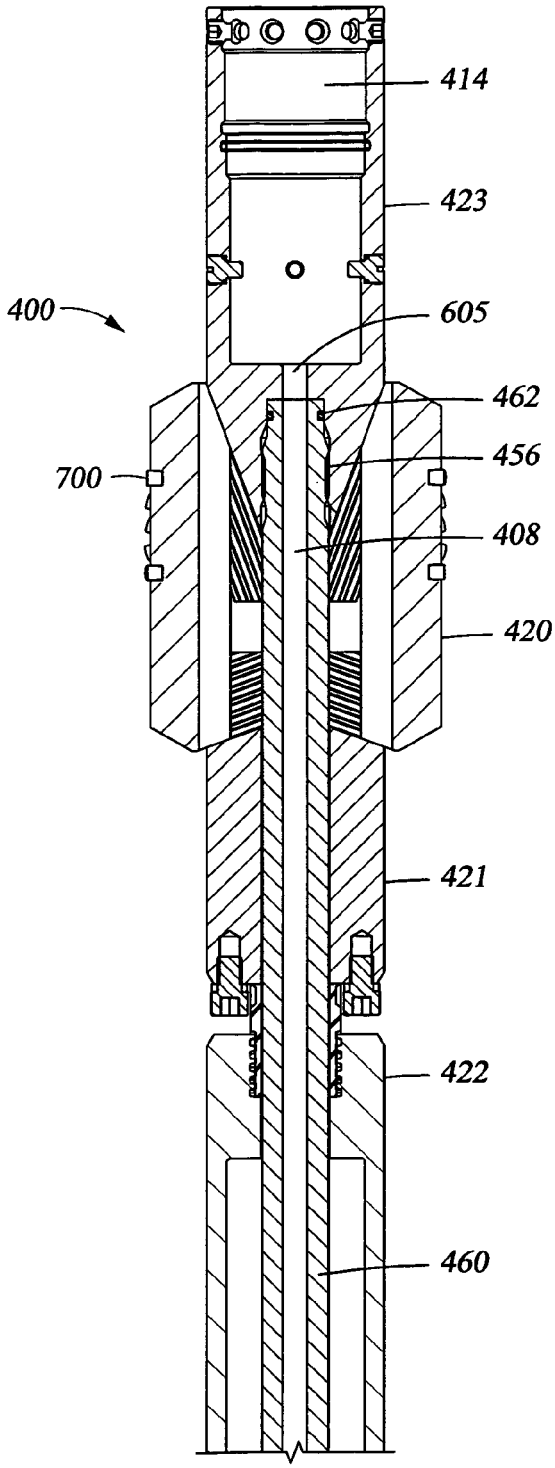
FIGS. 4A and 4B, when viewed end to end, decipt a side, cross section view of the expandable anchoring tool in an expanded position.
Figure 4B:
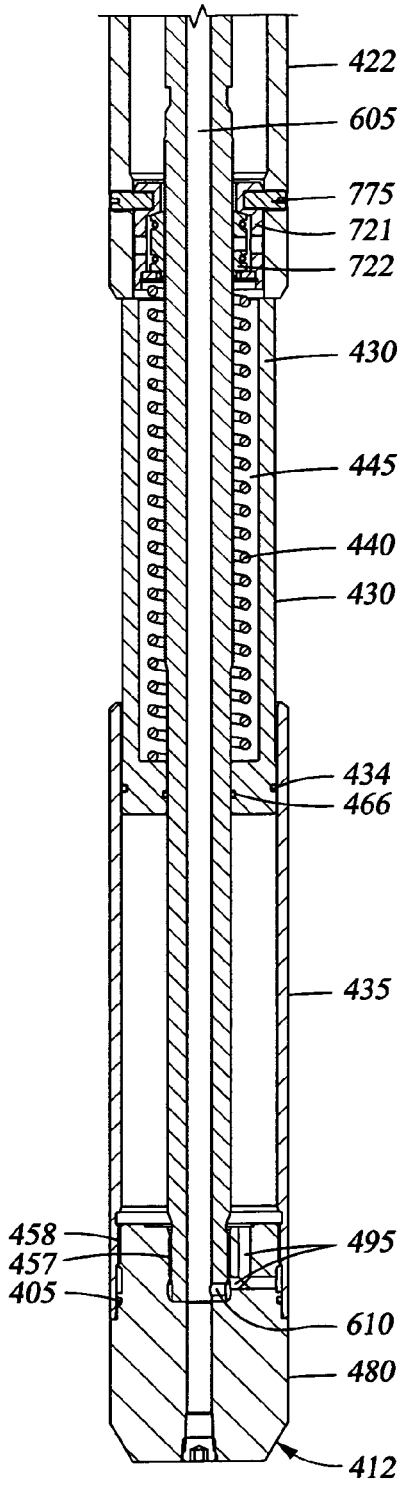

FIGS. 4A–4B and 5 depict the tool 400 with the slips 420 in the expanded position, extending radially outwardly from the body 410. The tool 400 has two operational positions—namely a collapsed position as shown in FIGS. 2A–2B for running into a wellbore and through a restriction, and an expanded position for grippingly engaging a wellbore, as shown in FIGS. 4A–4B.

In the embodiment shown in FIGS. 2A–2B and FIGS. 4A–4B, hydraulic force causes the slips 420 to expand outwardly to the position shown in 4A–4B. To actuate the tool 400, fluid flows along path 605, through ports 495 in the nose 480, along path 610 into the piston cylinder 435. This pressure causes the piston 430 to move axially upwardly from the position shown in 2A–2B to the position shown in 4A–4B. Therefore, differential pressure working across the piston 430 will cause the slips 420 of the tool 400 to move from a collapsed to an expanded position against the force of the biasing spring 440.

In the embodiment shown in FIGS. 2A–2B and 4A–4B, as the piston 430 moves axially upwardly, it engages the lower slip housing 422. Thereby, the lower slip housing 422 engages the slips 420*a*, which engage intermediate slip housing 421. The intermediate slip housing 421 engages the slips 420*b*, which thereby also engage the upper slip housing 423. The slips 420*a* and 420*b* will expand radially outwardly as they travel in channels 418 disposed in the upper, intermediate, and lower slip housings 423, 421, 422.

A preferred embodiment of the expandable anchoring tool 400 comprises four slips 420, wherein, a first pair of slips, each approximately 180 degrees from each other, are designed to extend in a first longitudinal plane, and a second pair of slips, each approximately 180 degrees from each other, and located axially below the first pair of slips, are designed to extend in a second longitudinal plane, wherein the angle between the first longitudinal plane and the second longitudinal plane is approximately 90 degrees.

Figure 6:
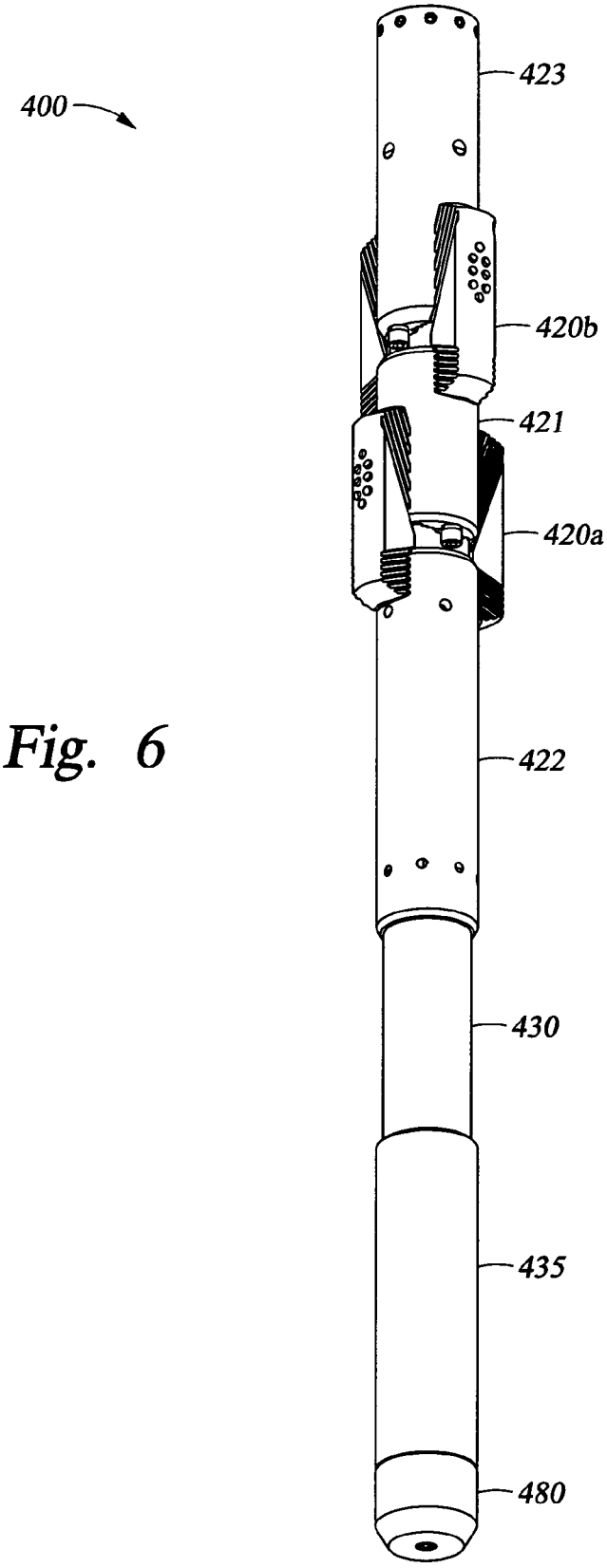
FIG. 6 is a perspective view of the tool in an expanded position.
Figure 7:
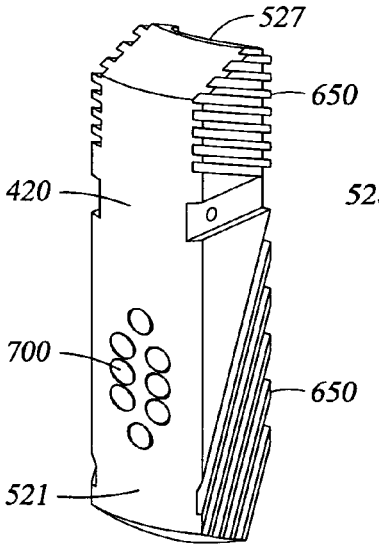
FIG. 7 is a perspective view of the slip of the expandable anchoring tool.
Figure 8:
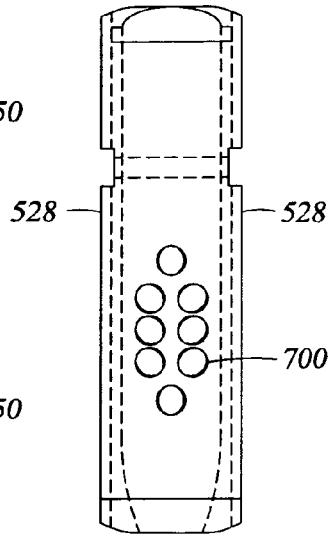
FIG. 8 is a front view of the slip of the expandable anchoring tool.
Figure 10:
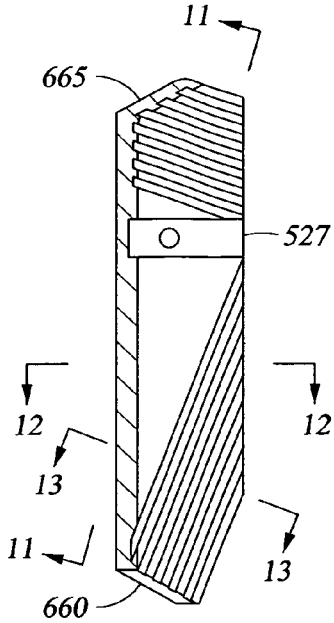
FIG. 10 is a side view of the slip of the expandable anchoring tool.
Figure 9:
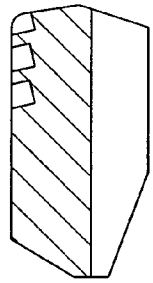
FIG. 9 is a cross section view of the slip of the expandable anchoring tool.
Figure 11:
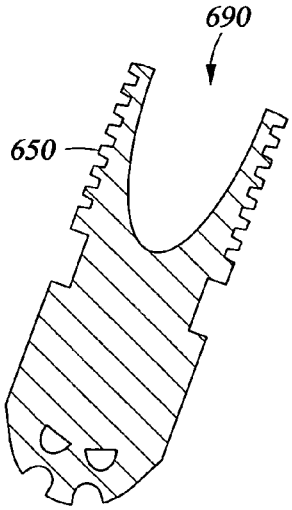
FIG. 11 is a cross section view of the slip in FIG. 10 taken along section line 11—11.

As best shown in FIG. 6, two slips 420*a* are spaced 180° circumferentially. An additional two slips 420*b* are also spaced 180° circumferentially relative to each other, but axially above slips 420*a* and rotated 90° circumferentially relative to slips 420*a*. This arrangement of the slips 420*a* and 420*b* is preferred to stabilize and centralize the tool 400 in the borehole. It should be appreciated, however, that multiple slips 420 may be disposed around the body 410. For example, there may be four slips 420 each approximately 90 degrees from each other or three slips 420, each approximately 120 degrees from each other.

Once the slips are engaged with the borehole, to prevent the tool 400 from returning to a collapsed position until so desired, the preferred embodiment is also provided with a locking means 720. In operation, downward movement of the piston also acts against a lock housing 721 mounted to the mandrel 460. The lock housing 721 cooperates with a lock nut 722 which interacts with the mandrel 460 to prevent release of the tool 400 when pressure is released. The inner radial surface of the lock housing 721 includes a plurality of serrations which cooperate with the inversely serrated outer surface of locking nut 722. Similarly, the outer radial surface of mandrel 460 includes serrations which cooperate with inverse serrations formed in the inner surface of locking nut 722. Thus, as the piston assembly causes the lock housing 721 to move downwardly, the locking nut 722 moves in conjunction therewith causing the inner serrations of the locking nut 722 to move over the serrations of the mandrel 460. The interacting edges of the serrations ensure that movement will only be in one direction thereby preventing the tool 400 from returning to a collapsed position.

FIGS. 7–13 show a preferred embodiment of the slips 420. In one embodiment, a multiplicity of radially aligned engagement "threads" and axially aligned "fins" (not shown) may extend from the outer surface of each of the slips and are designed, when the tool 400 is in the expanded position, to grip the casing wall or formation and thereby resist torsional as well as axial loads imposed on the anchor during sidetracking operations. In the preferred embodiment shown in FIGS. 7–13, buttons 700 may be set in the slips outer surface to grippingly engage the casing or formation. The preferred material for the gripping buttons 700 is tungsten carbide.

The slip 420 is shown in isometric view to depict a front surface 521, a back surface 527, a top surface 665, a bottom surface 660, and side surfaces 528. Top surface 665 and bottom surface 660 are preferably angled to assist in returning the tool from an expanded position to a collapsed position. The slip 420 also includes extensions 650 disposed along each side 528 of slip 420. The extensions 650 preferably extend upwardly at an angle from the back 527 of the slip 420. The extensions 650 protrude outwardly from the slip 420 to fit within corresponding channels 418 in the recesses 416 of the slip housings, 422, 421, 423 as shown in FIGS. 2A–2B and FIGS. 4A–4B. The interconnection between the slip extensions 650 and the body channels 418 increases the surface area of contact between the slips 420 and the slip housings 422, 421, 423, thereby providing a more robust expandable anchor tool 400 as compared to prior art tools.

Figure 12:
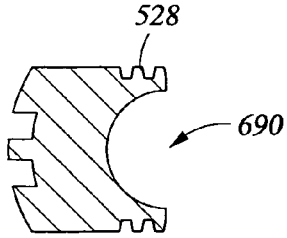
FIG. 12 is a cross section view of the slip in FIG. 10 taken along section line 12—12.
Figure 13:
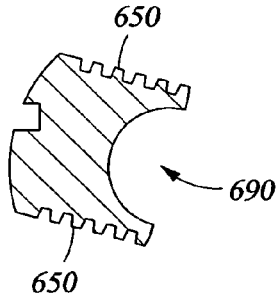
FIG. 13 is a cross section view of the slip in FIG. 10 taken along section line 13—13.

FIGS. 12 and 13 shows a vertical view from the direction of mandrel 420 and further shows cavity 690 in the back surface 527 the slip 420. The cavity 690 extends for the full length of slip 420. Cavity 690 can be of any desired configuration so long as it conforms to a substantial portion of the circumference of mandrel. If mandrel 420 is curvilinear, then cavity 690 will be of conforming curvilinearity so that mandrel 420 matingly engages cavity 690. For example, if mandrel 420 is essentially round, then cavity 690 will be essentially hemi-circular as shown in FIGS. 12 and 13.

It is another object of this invention to provide an expandable tool that can return from an expanded position to a collapsed position. Referring to FIGS. 4A–4B, the lock housing 721 is connected to the lower slip housing 422 by shear screws 775. To return the tool 400 to a collapsed position, an axial force is applied to the tool 400, sufficient to shear the shear screws 775, thereby releasing the locking means 720.

In summary, the various embodiments of the expandable tool of the present invention may be used as an anchoring tool below a restriction to grippingly engage a larger diameter. The various embodiments of the present invention solve the problems of the prior art and include other features and advantages. Namely, the embodiments of the present expandable tool are stronger than prior art thru tubing anchoring tools. The tool includes a novel assembly for moving the slips to the expanded position.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An expandable downhole anchoring tool positionable within a wellbore for use in cooperation with drilling equipment comprising:

a body including a plurality of angled channels formed into a wall of said body; and a plurality of moveable slips, wherein said plurality of moveable slips translates along said plurality of angled channels between a collapsed position and an expanded position;

wherein said plurality of moveable slips are positioned entirely within the body in the collapsed position;

further comprising a plurality of extensions disposed along a side surface of each slip of said plurality of moveable slips, said plurality of extensions corresponding to and engaging said plurality of channels; and wherein said plurality of slips comprises a first pair of slips spaced apart circumferentially and an axially spaced second pair of slips spaced apart circumferentially around said tool body, wherein said first pair of slips are offset about 90° from said second pair of slips.

2. The tool of claim 1 wherein said extensions and said channels comprise a drive mechanism for moving said plurality of slips between said collapsed position and said expanded position.

3. The tool of claim 1 wherein said extensions and said channels support loading on said plurality of slips in said expanded position.

4. The tool of claim 1 wherein said plurality of slips comprises at least one pair of slips spaced apart circumferentially around said tool body.

5. The tool of claim 1 wherein said plurality of slips includes angled surfaces for collapsing said slips into said body.

6. The tool of claim 1 and an axial flowbore extends through said body.

7. The tool of claim 1 further including a piston that translates said plurality of slips from said collapsed position to said expanded position.

8. The tool of claim 1 wherein said plurality of slips grippingly engage said wellbore in said expanded position.

9. The tool of claim 1 further including a locking means for preventing said plurality of slips from translating between said expanded position and said collapsed position.

10. The tool of claim 1 further including a releasing means for allowing said plurality of slips from translating between said expanded position and said collapsed position.

11. The tool of claim 1 wherein said plurality of slips are adapted to grippingly engage the wellbore.

12. The tool of claim 11 wherein each of said plurality of slips include at least one carbide insert for grippingly engaging said wellbore in said expanded position.

13. The tool of claim 11 wherein said plurality of slips includes a plurality of threads radially and axially aligned to resist axial and torsional forces for grippingly engaging said wellbore in said expanded position.

14. An expandable downhole anchoring tool positionable within a wellbore for use in cooperation with drilling equipment comprising:

a mandrel;

at least one slip housing having a plurality of angled channels formed into a wall thereof; and at least one pair of individual slips that translates along said angled channels between a collapsed position and an expanded position;

wherein said individual slips include a cavity for matingly engaging said mandrel while in said collapsed position; and wherein said individual slips do not extend radially beyond said at least one slip housing in the collapsed position;

further comprising a plurality of extensions disposed alone a side surface of each slip of said at least one pair of individual slips, said plurality of extensions corresponding to and engaging said plurality of channels; and wherein said at least one pair of slips comprises a first pair of slips spaced apart circumferentially and an axially spaced second pair of slips spaced apart circumferentially around said tool body, wherein said first pair of slips are offset about 90° from said second pair of slips.

15. The tool of claim 14 wherein said extensions and said channels comprise a drive mechanism for moving said at least one pair of slips between said collapsed position and said expanded position.

16. The tool of claim 14 wherein said extensions and said channels support loading on said at least one pair of slips in said expanded position.

17. The tool of claim 14 wherein said at least one pair of slips comprises at least one pair of slips spaced apart circumferentially around said tool body.

18. The tool of claim 14 wherein said at least one pair of slips includes angled surfaces for collapsing said slips into said body.

19. The tool of claim 14 and an axial flowbore extends through said mandrel.

20. The tool of claim 14 further including a piston that translates said at least one pair of slips from said collapsed position to said expanded position.

21. The tool of claim 14 wherein said at least one pair of slips grippingly engages said wellbore in said expanded position.

22. The tool of claim 14 further including a locking means for preventing said at least one pair of slips from translating between said expanded position and said collapsed position.

23. The tool of claim 14 further including a releasing means for allowing said plurality of slips from translating between said expanded position and said collapsed position.

24. The tool of claim 14 wherein said at least one pair of slips are adapted to grippingly engage the wellbore.

25. The tool of claim 24 wherein said slips comprise at least one carbide insert for grippingly engaging said wellbore in said expanded position.

26. The tool of claim 24 wherein said at least one pair of slips includes a plurality of threads radially and axially aligned to resist axial and torsional forces for grippingly engaging said wellbore in said expanded position.

* * * * *